US006601553B1

(12) United States Patent
Vattaneo et al.

(10) Patent No.: US 6,601,553 B1
(45) Date of Patent: Aug. 5, 2003

(54) MULTICYLINDER INTERNAL-COMBUSTION ENGINE WITH ELECTRONICALLY CONTROLLED HYDRAULIC DEVICE FOR CONTROLLING VARIABLE ACTUATION OF THE VALVES, INTEGRATED IN A PRE-ASSEMBLED UNIT MOUNTED ON THE ENGINE CYLINDER HEAD

(75) Inventors: Francesco Vattaneo, Orbassano (IT); Andrea Pecori, Orbassano (IT); Lorentino Macor, Orbassano (IT)

(73) Assignee: C.R.F. Societa Consortile per Azioni, Obrassano (IT)

( * ) Notice: Subject to any disclaimer, the term of this patent is extended or adjusted under 35 U.S.C. 154(b) by 0 days.

(21) Appl. No.: 10/259,450

(22) Filed: Sep. 30, 2002

(30) Foreign Application Priority Data

Feb. 21, 2002 (IT) ..... TO2002A000149

(51) Int. Cl.[7] ..... F01L 1/34

(52) U.S. Cl. ..... 123/90.15; 123/90.16; 123/90.12

(58) Field of Search ..... 123/90.11–90.16, 123/198 F; 251/129.15

(56) References Cited

U.S. PATENT DOCUMENTS 5,839,400 A * 11/1998 Vattaneo et al. ..... 123/90.16
6,138,621 A * 10/2000 Albanello et al. ..... 123/90.12
6,227,154 B1 * 5/2001 Wakeman ..... 123/90.16

* cited by examiner

*Primary Examiner*—Thomas Denion
*Assistant Examiner*—Kyle Riddle
(74) *Attorney, Agent, or Firm*—Sughrue Mion, PLLC

(57) ABSTRACT

Described herein is an internal-combustion engine provided with an electro-hydraulic device of an improved type for controlling variable actuation of the valves of the engine.

10 Claims, 7 Drawing Sheets

*Fig. 1* PRIOR ART

MULTICYLINDER INTERNAL-COMBUSTION ENGINE WITH ELECTRONICALLY CONTROLLED HYDRAULIC DEVICE FOR CONTROLLING VARIABLE ACTUATION OF THE VALVES, INTEGRATED IN A PRE-ASSEMBLED UNIT MOUNTED ON THE ENGINE CYLINDER HEAD

BACKGROUND OF THE INVENTION

The present invention relates to multicylinder internal-combustion engines of the type comprising:

at least one intake valve and at least one exhaust valve for each cylinder, each valve being provided with respective elastic return means, which push the valve towards a closed position for controlling respective intake and exhaust pipes; and at least one camshaft, for activating the intake and exhaust valves of the engine cylinders by means of respective tappets;

in which each intake valve is controlled by the respective tappet against the action of the aforesaid elastic return means by interposition of hydraulic means that include a pressurized fluid chamber;

said pressurized fluid chamber being designed to be connected by means of a solenoid valve to an exhaust channel in order to uncouple the valve from the respective tappet and bring about fast closing of the valve as a result of the respective elastic return means;

electronic control means for controlling each solenoid valve so as to vary the time and the opening stroke of the respective intake valve according to one or more operating parameters of the engine;

in which the hydraulic control means for controlling the intake valves of the engine and the solenoid valves associated thereto form part of a pre-assembled unit mounted on the engine cylinder head.

An engine of the type specified above is, for example, described and illustrated in the European patent application EP-A-0 803 642 in the name of the present applicant.

SUMMARY OF THE INVENTION

The purpose of the present invention is to further improve the device described above.

With a view to achieving the above purpose, the subject of the present invention is a multicylinder engine having all the aforementioned characteristics and further comprising the characteristics that form the subject of the characterizing part of the annexed claim 1.

BRIEF DESCRIPTION OF THE DRAWINGS

The present invention will now be described, with reference to the attached drawings, which are provided purely by way of non-limiting example, and in which.

DETAILED DESCRIPTION OF THE INVENTION

Figure 1:
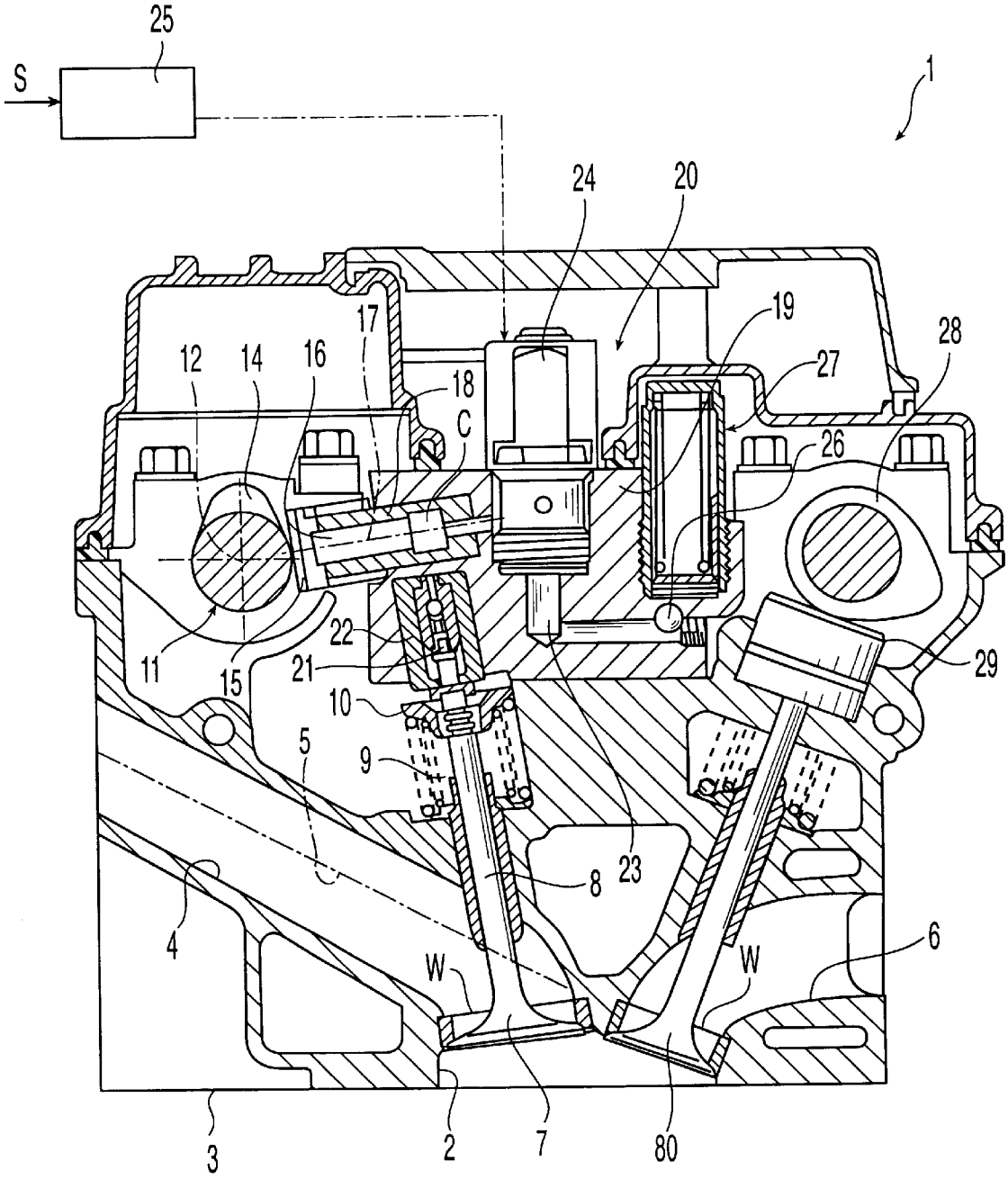
FIG. 1 is a cross-sectional view of an engine according to the known art, of the type described in the European patent application EP-A-0 803 642 in the name of the present applicant.

With reference to FIG. 1, the internal-combustion engine described in the previously mentioned European patent application EP-A-0 803 642 in the name of the present applicant is a multicylinder engine, for example, a four-cylinder in-line engine comprising a cylinder head 1. The cylinder head 1 comprises, for each cylinder, a cavity 2 formed in the base surface 3 of the head 1, which defines the combustion chamber, and into which there give out two intake pipes 4, 5 and two exhaust pipes 6. Communication of the intake pipes 4, 5 with the combustion chamber 2 is controlled by two intake valves 7 of the traditional poppet or mushroom type, each comprising a stem 8 slidably mounted in the body of the cylinder head 1. Each valve 7 is recalled to the closing position by springs 9 set between an internal surface of the cylinder head 1 and an end cup or bucket 10 of the valve. Opening of the intake valve 7 is controlled, in the way that will be described hereinafter, by a camshaft 11, which is mounted so that it can turn about an axis 12 within supports of the cylinder head 1 and which comprises a plurality of cams 14 for actuation of the valves.

Each cam 14 for controlling an intake valve 7 cooperates with the cup 15 of a tappet 16 slidably mounted along an axis 17, which, in the case of the example illustrated in the above-mentioned prior document, was set in a direction at substantially 90° with respect to the axis of the valve 7. The tappet 16 is slidably mounted within a bushing 18 carried by a body 19 of a pre-assembled unit 20, which incorporates all the electrical and hydraulic devices associated to operation of the intake valves, according to what is described in detail hereinafter. The tappet 16 is able to transmit a thrust to the stem 8 of the valve 7 so as to cause opening of the latter against the action of the elastic means 9 by fluids under pressure (typically oil coming from the lubricating circuit of the engine), which is present in a chamber C, and a piston 21 slidably mounted in a cylindrical body consisting of a bushing 22, which is carried by the body 19 of the subassembly 20. Once again in the known solution illustrated in FIG. 1, the pressurized-fluid chamber C, associated to each intake valve 7, can be set in communication with an outlet channel 23 by means of a solenoid valve 24. The solenoid valve 24, which may be of any known type suitable for the function illustrated herein, is controlled by electronic control means, designated as a whole by 25, according to the signals S that indicate operating parameters of the engine, such as the position of the accelerator and the engine r.p.m. When the solenoid valve 24 is opened, the chamber C enters into communication with the channel 23, so that the pressurized fluid present in the chamber C flows into the channel 23 and there is obtained a decoupling of the tappet 16 from the respective intake valve 7, which then rapidly returns to its closing position under the action of the return spring 9. By controlling communication between the chamber C and the outlet channel 23, it is therefore possible to vary the time and stroke of opening of each intake valve 7 as desired.

The outlet channels 23 of the various solenoid valves 24 all give out into one and the same longitudinal channel 26, which communicates with four pressure accumulators 27, only one of which is visible in FIG. 1. All the tappets 16 with the associated bushings 18, the pistons 21 with the associated bushings 22, the solenoid valves 24 and the corresponding channels 23, 26 are carried and made out of the aforesaid body 19 of the pre-assembled unit 20, to the advantage of speed and ease of assembly of the engine.

The exhaust valves 80 associated to each cylinder are controlled, in the embodiment illustrated in FIG. 1, in a traditional way, by a camshaft 28 by means of respective tappets 29, even though, in principle, there is not ruled out, both in the case of the prior document cited above and in the case of the present invention, an application of the system for variable actuation of the valves also under control of the exhaust valves.

Figure 2:
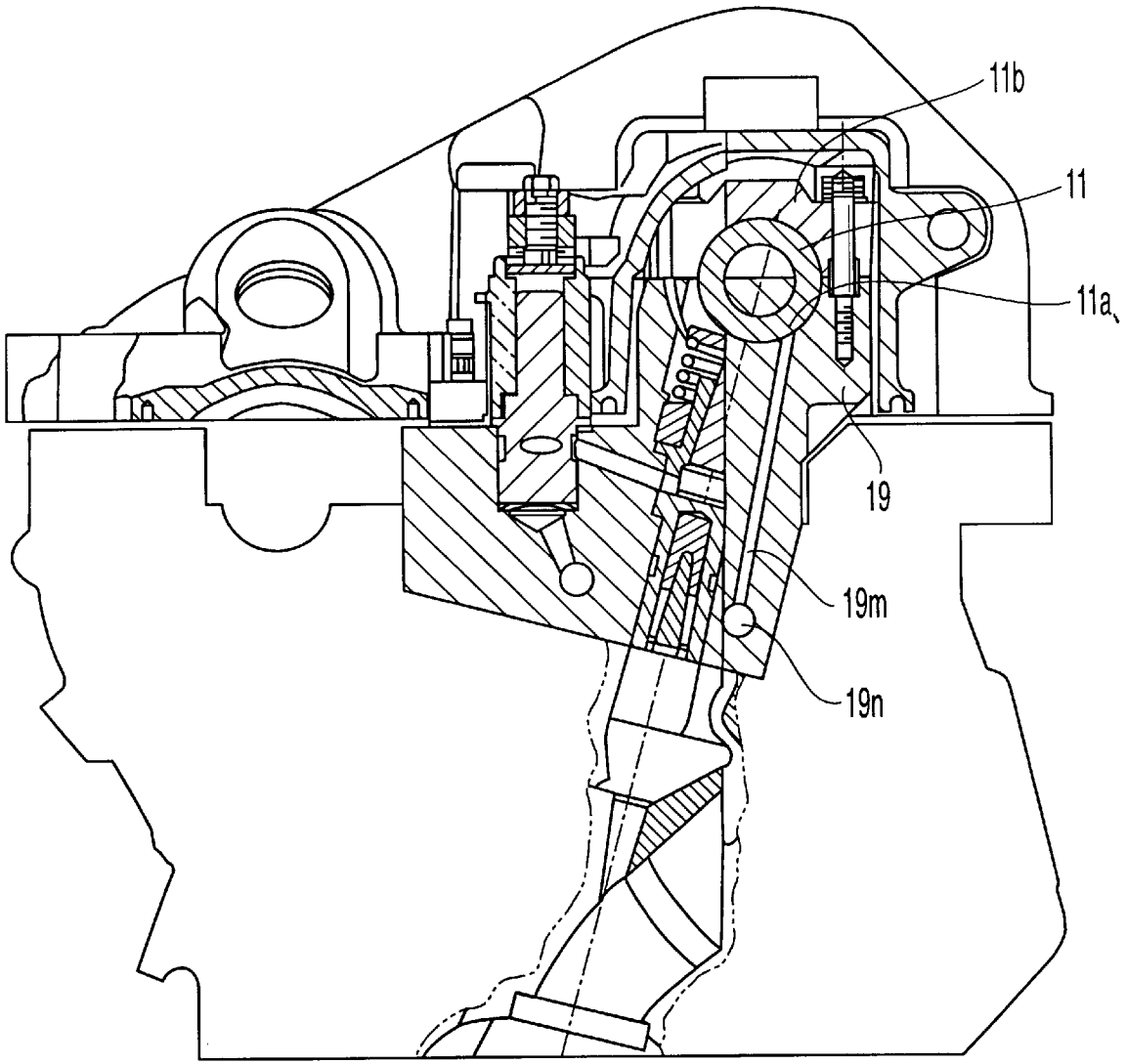
FIG. 2 is a cross-sectional view of a preferred embodiment of the engine according to the present invention.

FIG. 2 of the attached drawings illustrates, in cross-sectional view, the cylinder head of an example of embodiment of the engine according to the invention. As in the case of FIG. 1, the cylinder head incorporates a pre-assembled unit, which integrates the electro-hydraulic system of variable operation of the intake valves.

In FIG. 2 and in the subsequent figures, parts that are in common with those of FIG. 1 are designated using the same reference numbers.

A first important characteristic of the pre-assembled unit that forms part of the engine according to the invention lies in the fact that it integrates also the supports on which the camshaft 11 is mounted so that it can turn. FIG. 2 is a clear illustration of one of said supports, defined in part by a semicircular seat 11*a* made directly in the body 19, and in part in an opposed semicircular seat made in a cap 11*b* fixed by means of screws to the body 19.

According to a further characteristic of the invention, made in the body 19 are channels or ports 19*m* which enable arrival of lubricant to the supporting seats of the camshaft (see FIG. 2). The ports 19*m* branch off from a continuous longitudinal tunnel 19*n*, which is made in the body 19 of the pre-assembled unit.

Figure 5:
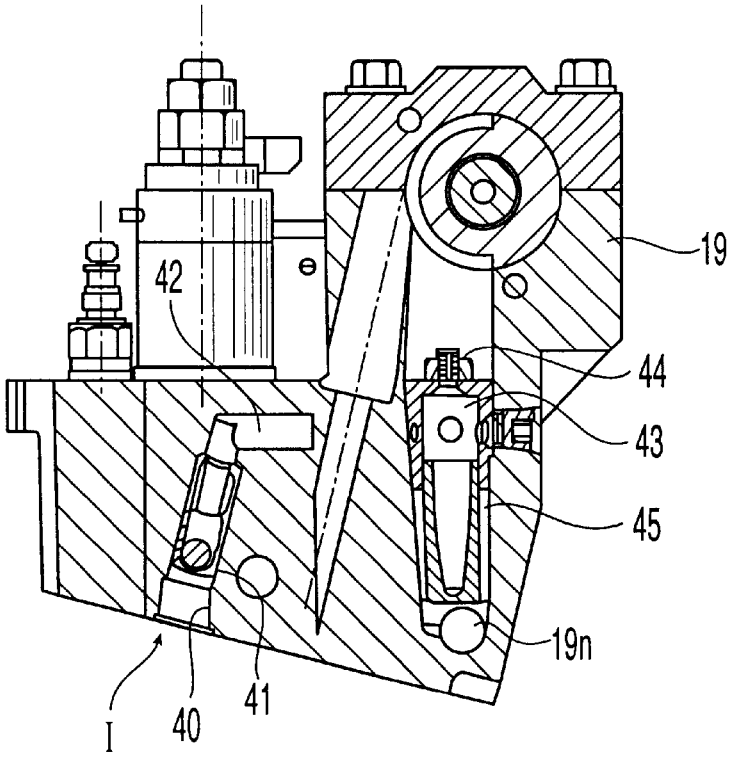
FIG. 5 is a cross-sectional view taken along the line V—V of FIG. 4.

FIG. 5 of the attached drawing shows the way in which the lubricant reaches the longitudinal tunnel 19*n*. The oil coming from the engine lubrication circuit enters the unit 19 through an inlet opening 40, a non-return valve 41, which prevents emptying of the oil from the circuit into the body 19, a pipe 42, and a chamber 43. The chamber 43 communicates at the top with a calibrated breather hole 44, which enables release into the outside environment of the air contained in the oil flow. At the bottom, the chamber 43 communicates with the longitudinal tunnel 19*n* by means of a filter 45, which is in itself of a known type.

Figure 6:
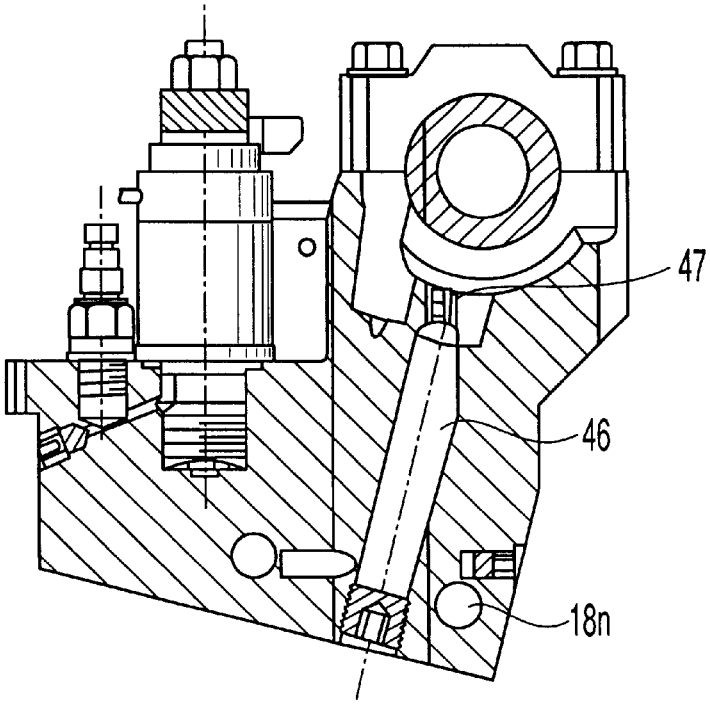
FIG. 6 is a cross-sectional view taken along the line VI—VI of FIG. 4.

A further characteristic of the pre-assembled unit forming part of the engine according to the invention lies in the fact that the body 19 includes cavities or storage areas 46 (see FIG. 6) for accumulation of the oil present in the circuit, the said cavities each being provided at the top with a calibrated hole 47 for release of the air present in the oil.

Figure 3:
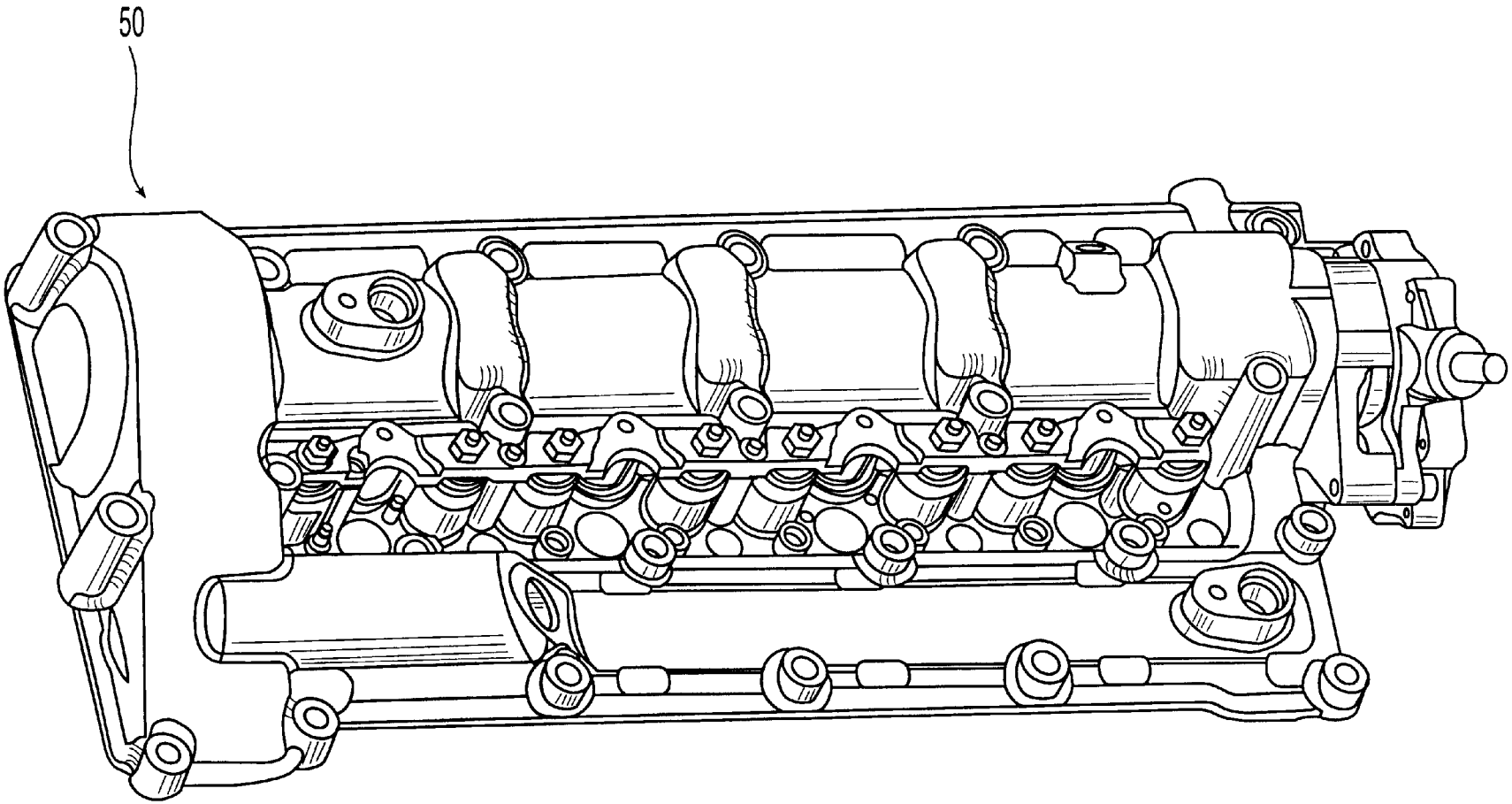
FIG. 3 is a perspective view of the pre-assembled unit incorporating the electro-hydraulic system for variable actuation of the intake valves of the engine according to the invention.
Figure 4:
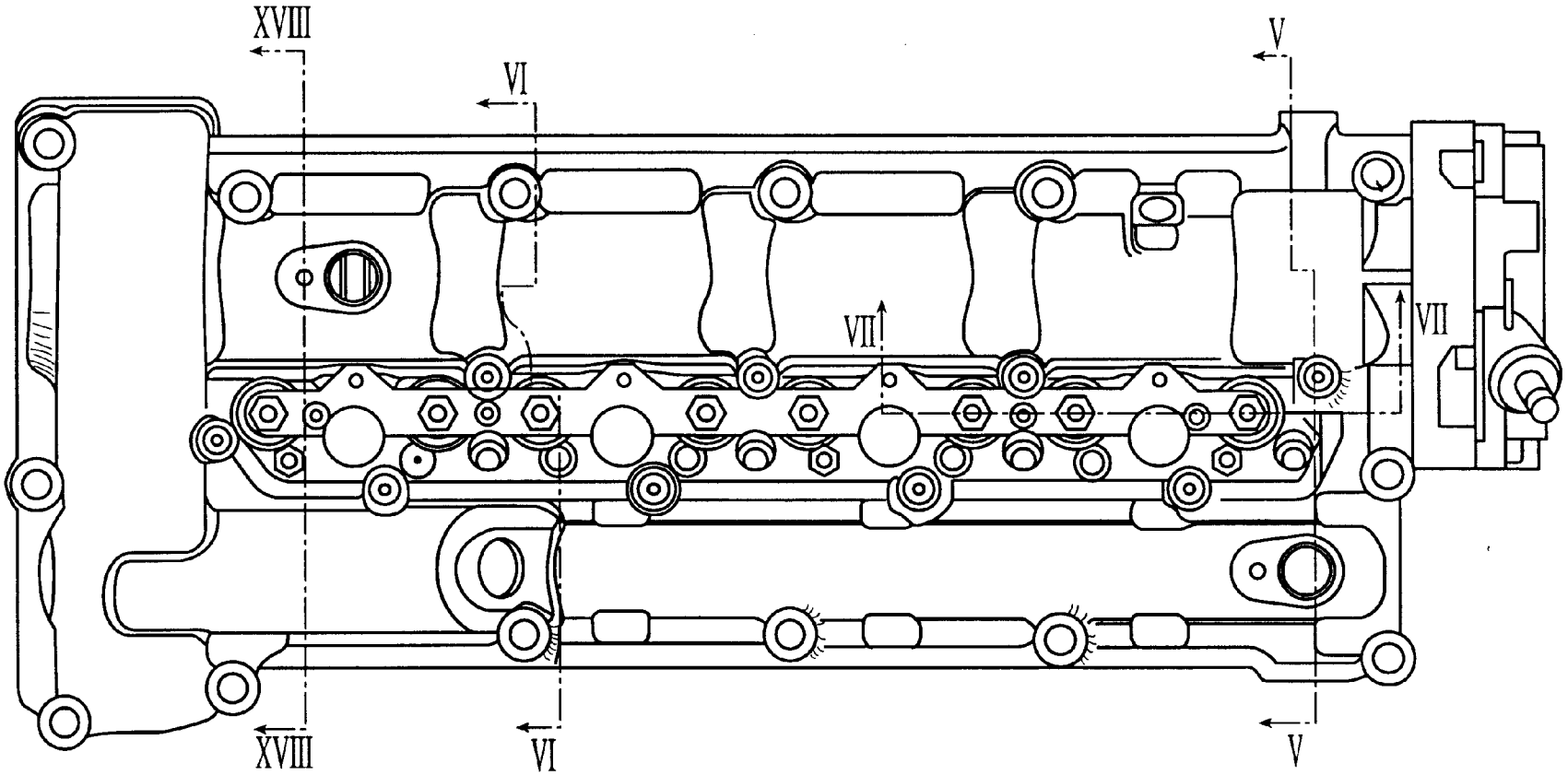
FIG. 4 is a plan view of the unit illustrated in FIG. 3.
Figure 7:
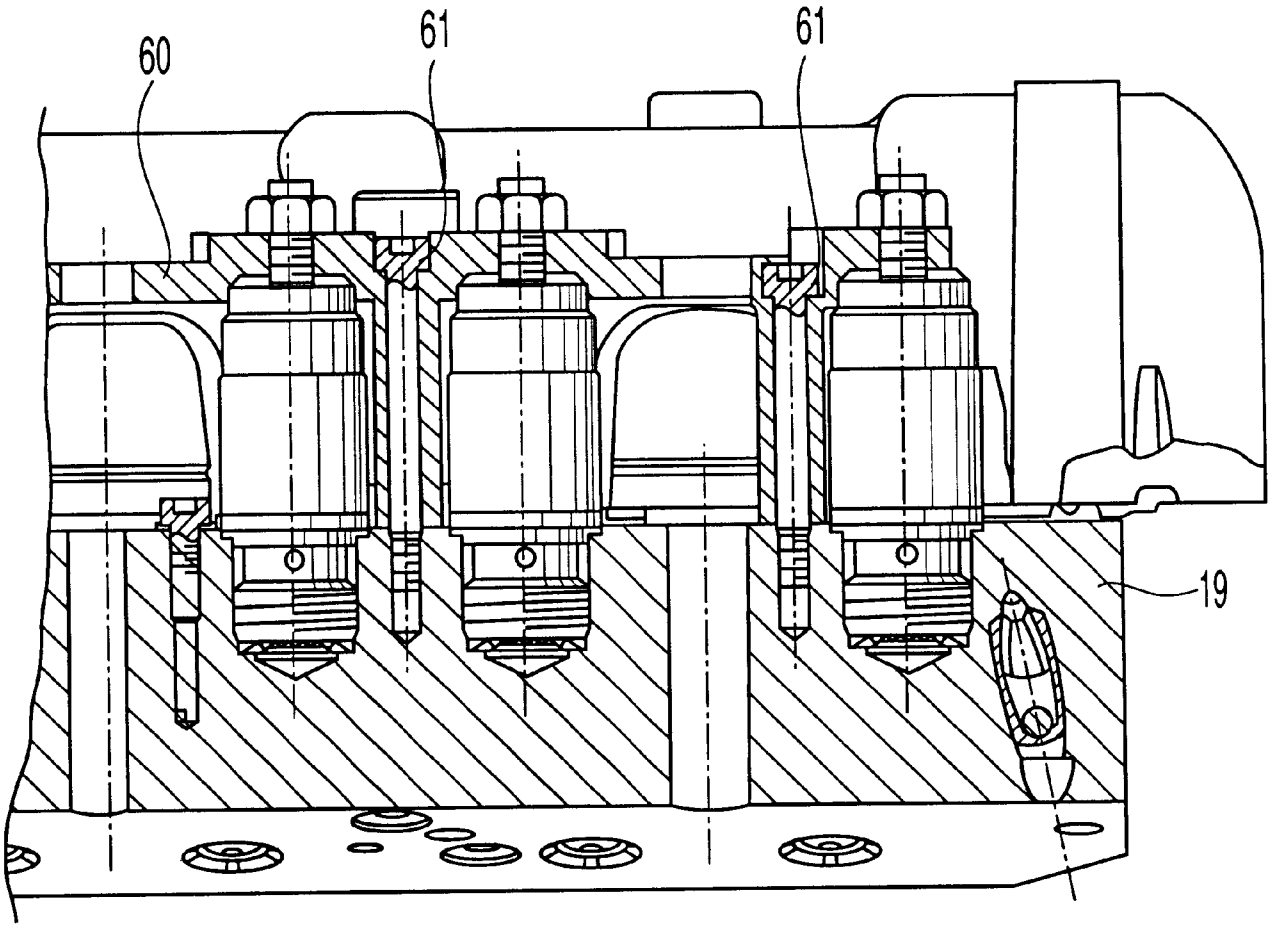
FIG. 7 is a partial longitudinal sectional view.
Figure 8:
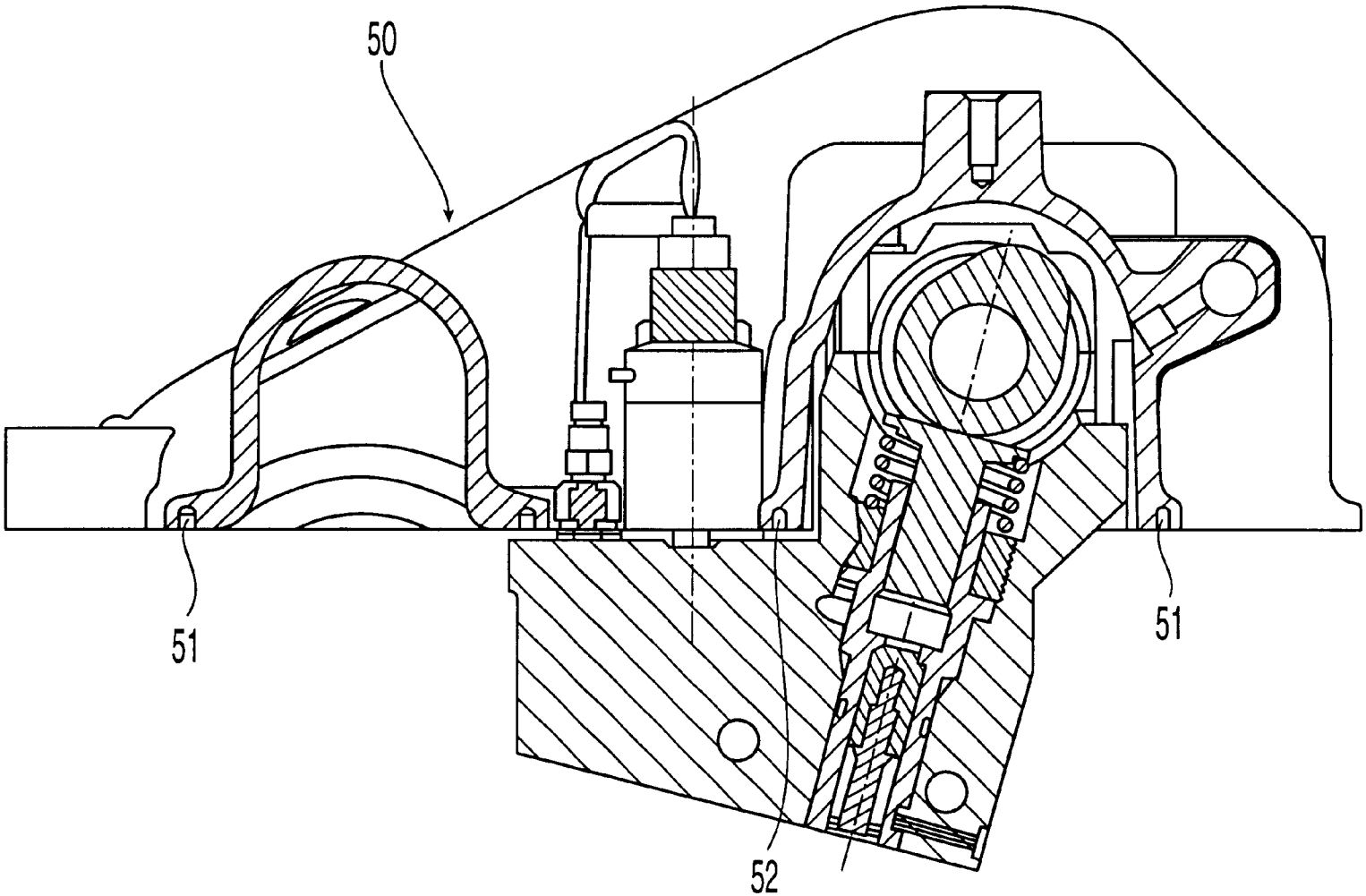
FIG. 8 is a sectional view of a valve unit showing the cover details.

The pre-assembled unit 20 is closed at the top by a lid 50 (see FIGS. 3 and 8). With reference in particular to FIG. 8, the lid 50 has a peripheral base edge having a perimetrical groove 51 for mounting of a seal designed to be set between the lid 50 and the engine cylinder head. The body of the lid has a central rectangular hole delimited by a perimetrical edge having a peripheral groove 52, designed to receive a further annular seal for separating the oil-bath environment from the area of the solenoid valves, which come out of the lid 50 through the central opening delimited by the seal mounted in the groove 52. Thanks to the aforesaid arrangement, the coils of the solenoid valves are dry, and the wiring of the coils can be integrated on a common bracket 60 for fixing the solenoid valves, the said bracket being fastened by means of screws 61 to the body 19 (FIG. 7).

Of course, without prejudice to the principle of the invention, the details of construction and the embodiments may vary widely with respect to what is described and illustrated purely by way of example, without thereby departing from the scope of the present invention.

What is claimed is:

1. A multicylinder internal-combustion engine, comprising:

at least one intake valve and at least one exhaust valve for each cylinder, each valve being provided with respective elastic return means, which push the valve towards a closed position for controlling respective intake and exhaust pipes; and at least one camshaft, for activating the intake valves and exhaust valves of the engine cylinders by means of respective tappets;

in which each intake valve is controlled by the respective tappet against the action of the aforesaid elastic return means by interposition of hydraulic means that include a pressurized fluid chamber;

said pressurized fluid chamber being designed to be connected by means of a solenoid valve to an exhaust channel in order to uncouple the valve from the respective tappet and bring about fast closing of the valve as a result of the respective elastic return means;

electronic control means for controlling each solenoid valve so as to vary the time and the opening stroke of the respective intake valve according to one or more operating parameters of the engine;

in which the hydraulic control means for controlling the intake valves of the engine and the solenoid valves associated thereto form part of a pre-assembled unit mounted on the engine cylinder head;

wherein associated the aforesaid pre-assembled unit integrates also the supports on which the camshaft is mounted so that it can turn.

2. The engine according to claim 1, wherein each of the supports of the camshaft is defined in part by a seat made directly in the body of the aforesaid pre-assembled unit and in part in a cap fixed by means of screws to the aforesaid body.

3. The engine according to claim 1, wherein made in the body of the pre-assembled unit are channels or ports for supplying lubricant to the supporting seats of the camshaft.

4. The engine according to claim 3, wherein the aforesaid ports that supply lubricant to the supporting seats of the camshaft branch off from a continuous longitudinal tunnel, which is also made in the body of the pre-assembled unit.

5. The engine according to claim 4, wherein the aforesaid continuous longitudinal tunnel communicates with the lubrication circuit of the engine via a non-return valve.

6. The engine according to claim 4, wherein the aforesaid continuous longitudinal tunnel communicates with the lubrication circuit of the engine via a chamber, which communicates at the top with a calibrated breather hole for enabling release into the outside environment of the air contained in the oil flow.

7. The engine according to claim 6, wherein the aforesaid chamber, which communicates at the top with the breather hole communicates at the bottom with the longitudinal tunnel via a filter.

8. The engine according to any of the preceding claims, wherein the body of the pre-assembled unit includes cavities for accumulation of the oil present in the circuit, the said cavities each being provided at the top with a calibrated hole for release of the air present in the oil.

9. The engine according to claim 1, wherein the aforesaid pre-assembled unit is closed at the top by a lid, which has a peripheral base edge having a perimetral groove for mounting of a seal designed to be set between the lid and the engine cylinder head, the body of the lid moreover having a central hole delimited by a perimetral edge having a peripheral groove, designed to receive a further annular seal for separating the oil-bath environment from the area of the solenoid valves, which come out of the lid through the central opening delimited by the seal mounted in the groove in such a way that the coils of the solenoid valves are dry.

10. The engine according to claim 9, wherein the wiring of the coils are integrated on a common bracket for fixing the solenoid valves, the said bracket being fastened by means of screws to the body of the pre-assembled unit.

* * * * *